US011686526B2

(12) United States Patent
Stubblefield et al.

(10) Patent No.: US 11,686,526 B2
(45) Date of Patent: Jun. 27, 2023

(54) REFRIGERATED DISPLAY CASE WITH SHELF INDEXING SYSTEM

(71) Applicant: Hill Phoenix, Inc., Conyers, GA (US)

(72) Inventors: Steve Stubblefield, Mechanicsville, VA (US); Kelly Sayko, Conyers, GA (US)

(73) Assignee: Hill Phoenix, Inc., Conyers, GA (US)

( * ) Notice: Subject to any disclaimer, the term of this patent is extended or adjusted under 35 U.S.C. 154(b) by 0 days.

(21) Appl. No.: 17/668,019

(22) Filed: Feb. 9, 2022

(65) Prior Publication Data

US 2022/0170691 A1 Jun. 2, 2022

Related U.S. Application Data

(62) Division of application No. 16/885,925, filed on May 28, 2020.

(51) Int. Cl.

| | |
|---|---|
| ***F25D 25/02*** | (2006.01) |
| ***A47F 3/04*** | (2006.01) |
| ***F25D 23/06*** | (2006.01) |
| ***A47B 57/34*** | (2006.01) |
| ***A47B 57/42*** | (2006.01) |

(52) U.S. Cl.

CPC ..... *F25D 25/02* (2013.01); *A47B 57/34* (2013.01); *A47B 57/42* (2013.01); *A47F 3/0486* (2013.01); *F25D 23/065* (2013.01); *F25D 2323/06* (2013.01); *F25D 2500/02* (2013.01)

(58) Field of Classification Search

CPC ..... F25D 2323/06; F25D 2325/00; F25D 23/065; F25D 2500/02; F25D 25/02; A47F 3/0486; A47B 57/34; A47B 57/42

See application file for complete search history.

(56) References Cited

U.S. PATENT DOCUMENTS

| | | | | |
|---|---|---|---|---|
| 3,162,416 | A | 12/1964 | Amarillas | |
| 3,900,112 | A | 8/1975 | Azzi et al. | |
| 4,453,641 | A | 6/1984 | Rasmussen et al. | |
| 4,811,670 | A | 3/1989 | Koivites et al. | |
| 5,279,231 | A | 1/1994 | Koivites et al. | |
| 5,988,403 | A | 11/1999 | Robideau | |
| 6,644,609 | B1 * | 11/2003 | Scott | A47B 96/1458 248/909 |
| D598,686 | S | 8/2009 | Erickson | |
| 8,231,017 | B2 | 7/2012 | Clontz et al. | |
| 8,863,541 | B2 | 10/2014 | Swofford et al. | |
| 8,979,311 | B2 | 3/2015 | Kramer et al. | |
| 10,117,525 | B2 * | 11/2018 | LaMontagne | A47F 3/0469 |

(Continued)

FOREIGN PATENT DOCUMENTS

| | | |
|---|---|---|
| CA | 2739278 | 11/2011 |
| WO | WO 2018086934 | 5/2018 |

*Primary Examiner* — Andrew M Roersma

(74) *Attorney, Agent, or Firm* — Fish & Richardson P.C.

(57) ABSTRACT

A refrigerated display case is provided. The refrigerated display case includes a rear wall has a first end, a second end disposed opposite the first end and a plurality of markings disposed between the first end and the second end. A mounting rail is coupled to the rear wall. A shelf is adjustably coupleable to the mounting rail at a plurality of positions between the first end and the second end of the rear wall. The plurality of markings are configured to indicate a distance from the first end of the rear wall to the shelf based on alignment of the shelf with at least one of the plurality of markings.

20 Claims, 5 Drawing Sheets

(56) References Cited

U.S. PATENT DOCUMENTS

| | | | | |
|---|---|---|---|---|
| 10,126,042 | B2 | 11/2018 | Cetinyol et al. | |
| 10,477,988 | B2 * | 11/2019 | Bryan | A47F 13/00 |
| 10,660,435 | B2 | 5/2020 | Miller, Jr. et al. | |
| 11,160,374 | B1 | 11/2021 | Davis | |
| 2002/0153335 | A1 | 10/2002 | Robideau | |
| 2002/0153814 | A1 | 10/2002 | Robideau | |
| 2008/0180847 | A1 | 7/2008 | Brooks et al. | |
| 2010/0313588 | A1 * | 12/2010 | Swofford | A47F 3/0443 62/251 |
| 2011/0266232 | A1 | 11/2011 | Kramer et al. | |
| 2013/0186847 | A1 | 7/2013 | Kramer et al. | |
| 2013/0213918 | A1 | 8/2013 | Doyle et al. | |
| 2015/0034579 | A1 | 2/2015 | Kahler et al. | |
| 2017/0299387 | A1 | 10/2017 | Bryan et al. | |
| 2018/0037245 | A1 | 2/2018 | Kahler et al. | |
| 2018/0003252 | A1 | 11/2018 | Welk et al. | |
| 2019/0239641 | A1 * | 8/2019 | Miller, Jr. | A47B 57/04 |
| 2021/0369009 | A1 | 12/2021 | Stubblefield et al. | |
| 2022/0031070 | A1 | 2/2022 | Brunner et al. | |

* cited by examiner

REFRIGERATED DISPLAY CASE WITH SHELF INDEXING SYSTEM

CROSS-REFERENCE TO RELATED APPLICATIONS

This application is a divisional application of and claims priority to U.S. patent application Ser. No. 16/885,925, filed on May 28, 2020, the entire contents of which are incorporated by reference herein.

BACKGROUND

The present disclosure relates generally to the field of refrigeration systems, including refrigerated display cases. More specifically, the present disclosure relates to the field of shelving systems for refrigeration systems.

SUMMARY

At least one embodiment of the present disclosure is a refrigerated display case having a rear wall. The rear wall includes a first end, a second end, opposite the first end, and a plurality of markings disposed between the first end and the second end. A mounting rail is coupled to the rear wall, and a shelf is adjustably coupled to the mounting rail at a plurality of positions between the first end and the second end of the rear wall. The plurality of markings are configured to indicate a distance from the first end of the rear wall to the shelf based on alignment of the shelf with at least one of the plurality of markings.

Another embodiment of the present disclosure is a panel assembly for a refrigerated display including a panel. The panel includes a first end, a second end opposite the first end, a first side extending between the first end and the second end, a second side opposite the first side and extending between the first end and the second end, and a plurality of markings disposed between the first end and the second end. The plurality of markings are configured to indicate a distance from the first end such that a user may quickly identify the distance to facilitate positioning of shelves in the refrigerated display case. The plurality of markings includes a first set of markings and a second set of markings. The first set of markings is disposed in a plurality of rows, each of the plurality of rows parallel to the first end. The second set of markings is aligned with a subset of the first set of markings and configured as numeric values indicating the distance from the first end to the numeric values.

Another embodiment of the present disclosure is a method of assembling a display area for a refrigerated display case. The method includes coupling a panel to a plurality of mounting rails. The panel has a plurality of markings. The plurality of markings is configured to indicate distances from a first panel end to a plurality of positions between the first panel end and a second panel end, the second panel end opposite the first panel end. The method further includes determining a first desired height for installation of a first shelf, and selectively coupling the first shelf to at least one of the plurality of mounting rails, based on determining the first desired height, such that a top surface of the first shelf aligns with at least one of the plurality of markings.

DETAILED DESCRIPTION

Referring generally to the FIGURES, a refrigerated display case and components thereof are shown, according to various exemplary embodiments. The refrigerated display case may include a vapor compression refrigeration system or other refrigeration system or systems. In some implementations, the refrigeration system may be used to provide cooling for temperature-controlled displays in a supermarket or other similar facility. Accordingly, it may be desirable to display products on shelves within the refrigerated display case based on predefined merchandising pans (e.g., plan-o-grams).

Before discussing further details of the refrigeration system and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, transmission of forces, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 1:
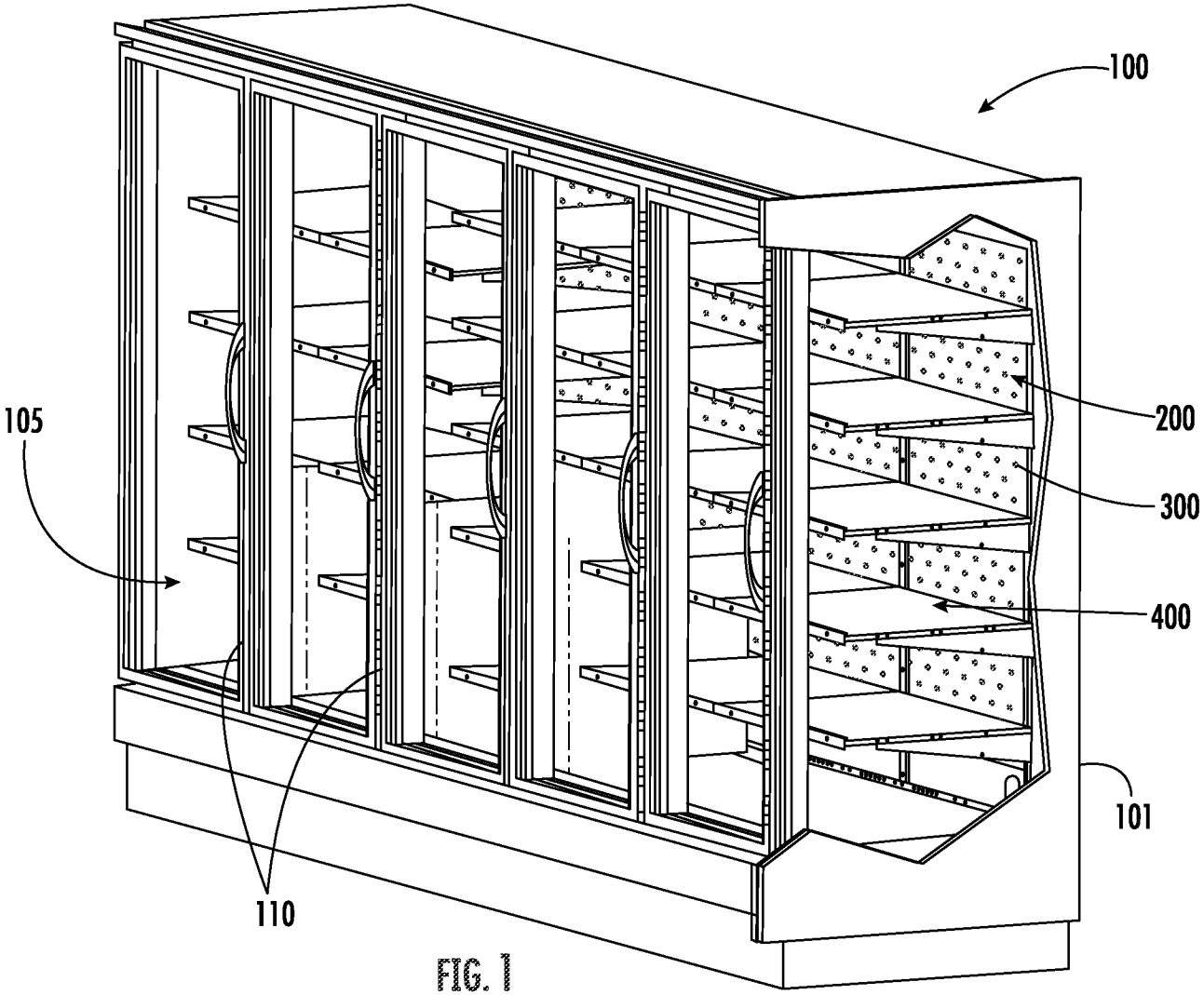
FIG. 1 is a perspective view of a refrigerated display case according to an exemplary embodiment.

Referring now to FIG. 1, a perspective view of a refrigerated display case 100 is shown, according to an exemplary embodiment. The refrigerated display case 100 includes a refrigeration body 101 which defines a display space 105. The display space 105 may be used to selectively display products (e.g., based on a Plan-O-Gram). The display space 105 may be temperature controlled such that the products selected to be displayed are kept at a constant temperature. For example, a user may desire to display a product and keep the temperature of the product below room temperature (e.g., less than 20° C.).

In some embodiments, the refrigerated display case 100 may include a mechanical-compression refrigeration system, an absorption refrigerating system, an evaporative cooling system, or a thermoelectric refrigeration system configured to selectively control a temperature of the display space 105. The refrigeration system may be a closed loop unit positioned on or in the refrigerated display case. Alternatively, the refrigerated display case 100 may be part of a large refrigeration loop connecting to additional refrigerated display cases.

A rear portion of the display space 105 is defined by panels 200. Mounting rails 300 are coupled to the sides of the panels 200 as shown. The display space 105 also includes shelves 400 coupled to at least one of the mounting rails 300. The panels 200 and the mounting rails 300 include an indexing system configured to facilitate placement of the shelves 400. Each of the shelves 400 is configured to support one or more of the products displayed in the display space 105. The refrigerated display case 100 also includes doors 110, as shown. The doors 110 may be used to facilitate thermal regulation within the display space. In some embodiments, the refrigerated display case 100 may have an open front (e.g., without doors 110).

In some embodiments, the refrigerated display case 100 may include more or fewer of the panels 200. In these implementations, the dimensions of the refrigerated display case 100 may be scaled to suitably contain each of the panels 200. Accordingly, the refrigerated display case 100 may include more or fewer of the mounting rails 300 such that each of the panels 200 has two adjacent mounting rails 300. For example, the refrigerated display case 100 may include two of the panels 200 and three of the mounting rails 300. In this arrangement, one of the mounting rails 300 is in common with both of the panels 200. In other arrangements, each panel 200 is provided with two dedicated mounting rails 300. Similarly, the refrigerated display case may include more or fewer shelves 400. The amount of shelves 400 may depend on products selected to be displayed within the display space 105. Additionally, the shelves may be positioned relative to the panel 200, the display area 105, or each other based on the product or products selected to be displayed.

Figure 2:
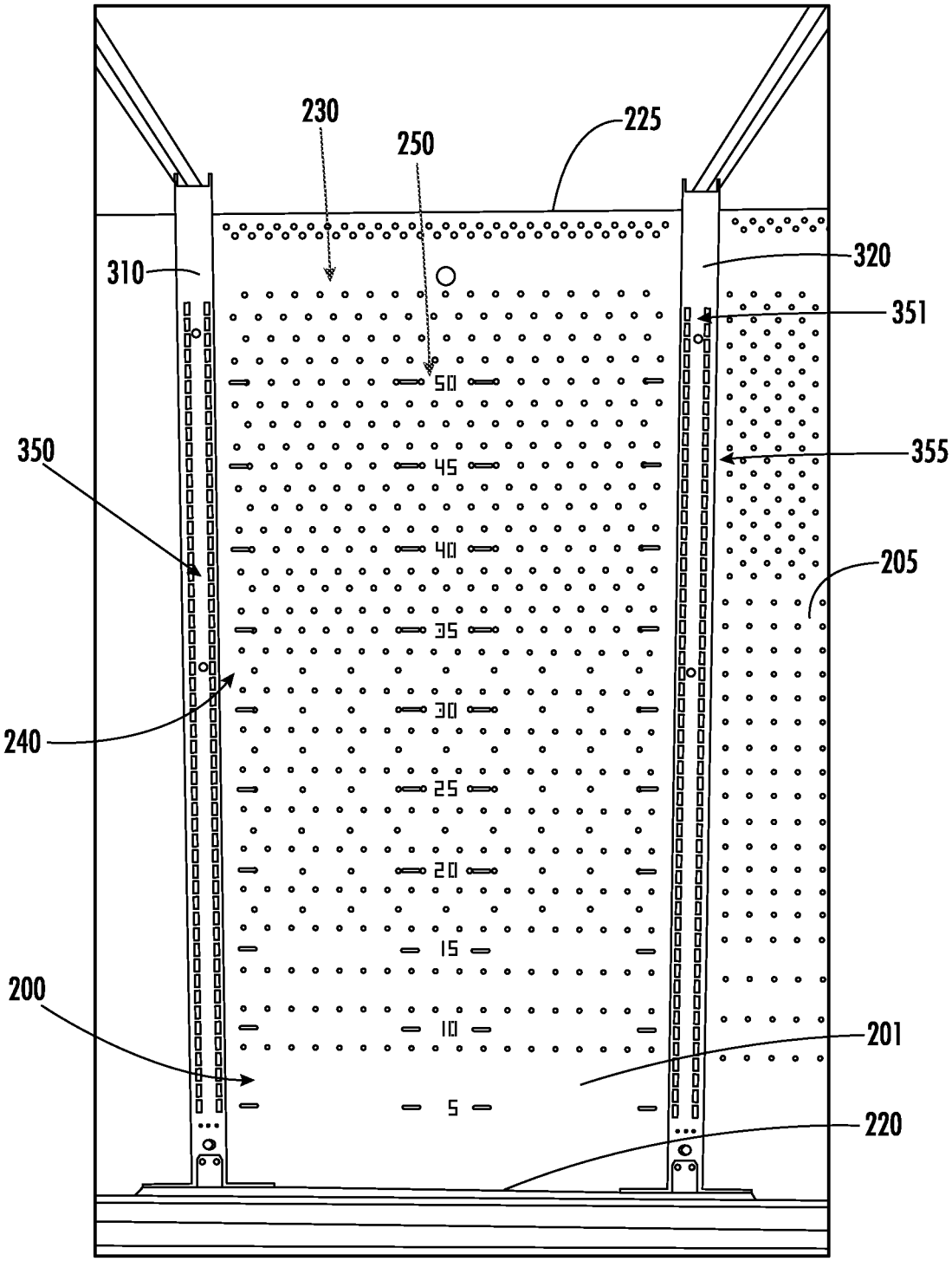
FIG. 2 is a front view of a panel of the refrigerated display case of FIG. 1, according to an exemplary embodiment.

Referring now to FIG. 2, a front view of a first panel 201 is shown, according to an exemplary embodiment. The first panel 201 is an embodiment of the panels 200 of FIG. 1. The first panel 201 is shown as having a first end 220 and a second end 225 opposite the first end 220. The first end 220 may be defined by a bottom end of the display space 105 (also called a merchandising deck). The first panel 201 includes a shelf indexing system shown as a plurality of markings 230. The markings 230 is shown extending between the first end 220 and the second end 225. The plurality of markings 230 is configured to indicate a distance from the first end 220 such that a user may quickly identify the distance from the first end to at least one of the plurality of markings 230.

The plurality of markings 230 includes a first set of markings 240. The first set of markings 240 is shown as circular holes formed through the panel 200. In other embodiments the first set of markings may have a different geometry (e.g., square, triangular, etc.).

The first set of markings 240 is show to be arranged in rows, each of the rows is parallel to the first end 220. Each of the rows may include one or more markings of the first set of markings 240. For example, each of the rows may include between 15 and 20 markings of the first set of markings 240. The rows may be spaced from each other at regular or predefined intervals. For example, the rows may be spaced apart by about 0.5 inches to about 10 inches. More specifically, the rows may be spaced apart by about 1 inch. In other embodiments, the rows may be spaced apart by more than 10 inches or less than 0.5 inches to suitably subdivide the panel 200 such that a user may quickly determine the distance from the first end 220 to one or more of the first set of markings 240. In yet other embodiments, the rows may be irregularly spaced or intermittently spaced. For example, one or more rows may be skipped such that the rows are spaced by a greater distance. Alternatively, one or more rows may be added such that the rows are spaced by a lesser distance.

The plurality of markings 230 also includes a second set of markings 250. The second set of markings 250 are configured as depictions of numeric values (e.g., numbers, Roman numerals, other symbols or characters). Each of the depictions of the numeric values has a particular height and width such that a user may easily identify the numeric value being depicted. The size of the depiction of the numeric values may depend on the size of the panels 200, the positioning of the depiction of the numeric value relative to the rows of the first set of markings 240, or the numeric value being depicted. For example, each of the depiction of the numeric values may be centered on one of the rows of the first set of markings 240. In this example, each of the depiction of the numeric values may be sized such that each of the depiction of the numeric value is suitably larger each of the first set of markings 240. Alternatively the height and width of the depiction of the numeric value may be standardized and independent of the first panel 201 or other markings.

Each of the depictions of the numeric values is positioned in line with one of the rows of the first set of markings 240 such that a portion (e.g., top, center, bottom, etc.) of the depiction of the numeric value is centered with one of the rows of the first set of markings 240. The depictions of the numeric values indicate the distance from the first end 220 to the depiction of the numeric values. As shown, the rows of the first set of markings 240 may be spaced one inch apart, and the second set of markings may be spaced at every $5^{th}$ row. The second set of markings are therefore spaced five inches apart indicated by the numeric vales as shown. Each of the rows of the first set of markings 240 in line with each of the second set of markings 250 may include one or more markings have a different geometry or configuration. As shown in FIG. 2, each of the rows of the first set of markings 240 that are in line with each of the second set of markings 250 include oval shaped holes in line with the rows.

In some embodiments, the plurality of markings 230, including the first set of markings 240 and the second set of markings 250, are spaced apart relative to the size of the first panel 201 such that the first panel 201 is suitably subdivided by the plurality of markings 230. As shown, the plurality of markings 230 are configured as holes formed through the first panel 201. The holes may be punched or cut out of the first panel 201. More specifically, the holes may be punched using a specialized tool (e.g., a hole punching turret) to create geometric holes in the material of the first panel 201. The specialized tool may be configured to punch out the first set of markings 240. The specialized tool may also be configured to punch out the second set of markings 250 from the first panel 201. For example a ⅛"×1" rectangular punch may be used in a specific punch sequence to generate the shape of each of the numeric value characters (e.g., 0 through 9, etc.). In other embodiments, the plurality of markings 230 may be etched or drawn onto the first panel 201 (e.g., laser etching, chemical etching, paint, inking, etc.). In yet other embodiments, the plurality of markings 230 may extend only partially between the first end 220 and the second end 225. For example, as shown in FIG. 2, the first set of markings 240 extends only partially between the first end 220 and the second end 225.

Still referring to FIG. 2, the panel 201 is shown coupled to mounting rails 300 (e.g., mounting rail 310 shown on the left of panel 201 and mounting rail 320 shown on the right of panel 201). The mounting rails 300 include a plurality of slots 350. The slots are suitably adjacent to the panel 201 such that the slots extend from the first side 220 of the panel 201 to the second side 225 of the panel 201. The slots 350 are configured to receive a portion of a shelf.

In some embodiments, the mounting rails 300 are configured to be modular such that a single mounting rail (e.g., mounting rail 320) may be mounted between two of the panels 200 (e.g., first panel 201 and second panel 205). In this arrangement, the slots 350 of mounting rail 320 are disposed in two columns such that a first column of slots 351 is configured to receive a portion of a shelf to be mounted in front of panel 201 and a second column of slots 355 is configured to receive a portion of a shelf to be mounted in front of second panel 205.

Figure 3:
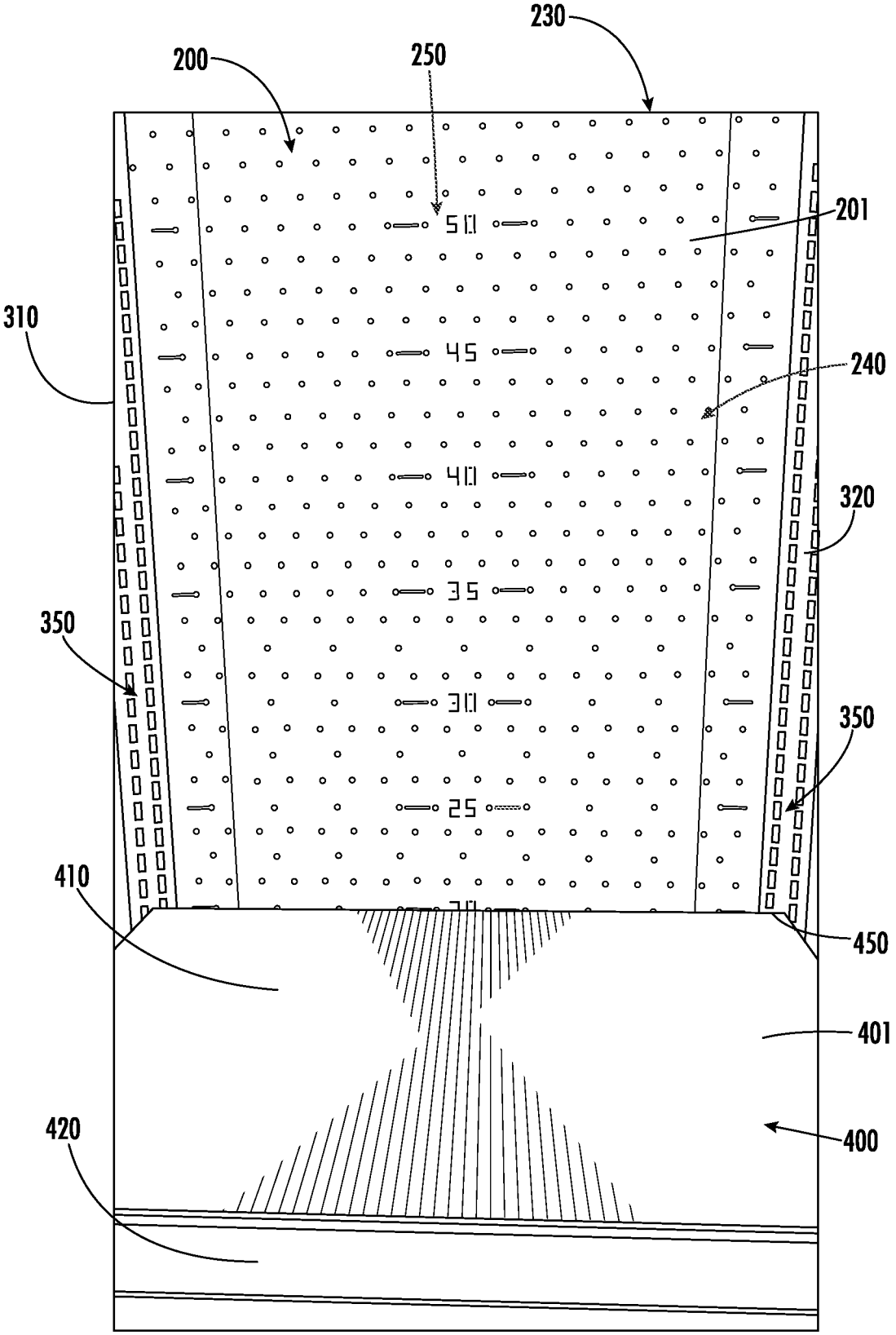
FIG. 3 is a front view of a display shelf and the panel of FIG. 2, according to an exemplary embodiment.

Now referring to FIG. 3, a front view of the first panel 201 with a first shelf 401 positioned in front of the first panel 201. The first shelf 401 has a top surface 410 and a skirt 420 disposed at least partially around the top surface. The first shelf 401 is configured to couple to the mounting rail 310 and the mounting rail 320 such that the top surface 410 aligns with one or more of the plurality of markings 230. The slots 350 in the mounting rails 310, 320 are positioned to ensure alignment of the shelf 401 with a row of the first set of markings 240 when the slots 350 receive the shelf 401. For example, as shown in FIG. 3, the top surface 410 aligns with a row the first set of markings 240 and at least one of the second set of markings 250, shown as a marking formed as a depiction of the numerical value twenty. Accordingly, in the embodiment shown, the second set of markings 250 indicate that the first shelf 401 is positioned at twenty units of distance (e.g., inches, centimeters, other increment) above a lower end 220 of the panel 201.

Figure 4:
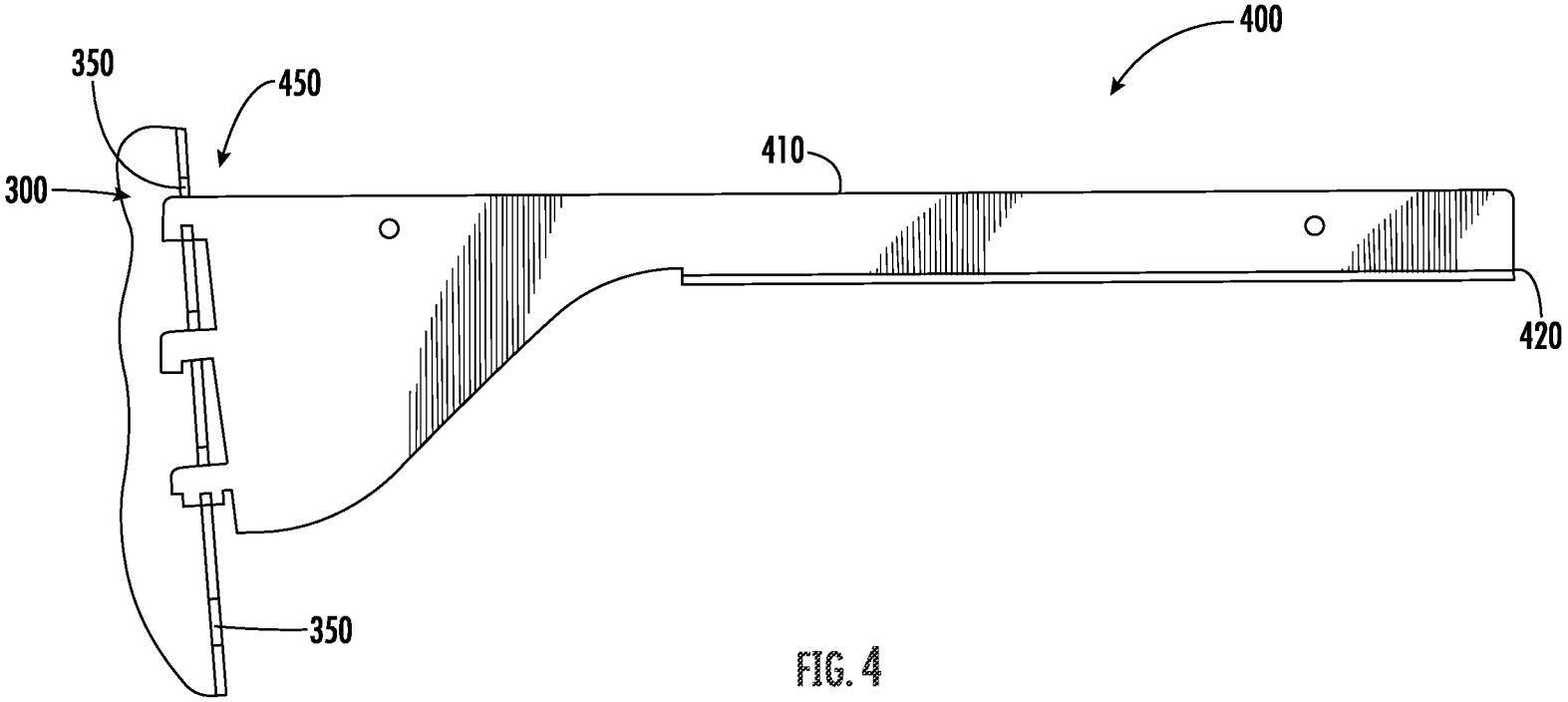
FIG. 4 is a side view of the shelf of FIG. 3, according to an exemplary embodiment.

Now referring to FIG. 4, a left side view of a first shelf 401 is shown, according to an exemplary embodiment. The first shelf 401 includes mounting flanges 450. As shown the mounting flanges 450 are shaped to interface with the slots 350 of the mounting rails 300 (e.g., mounting rail 310). The mounting flanges 450 are disposed on a left side and a right side of the first shelf 401 such that the shelf 401 is substantially symmetric from left to right. The geometric arrangement of the mounting flanges 450, the first shelf 401, and the slots 350 is such that the first shelf 401 is aligned with a row of the first set of markings 240 regardless of which set of slots 350 are used.

According to the exemplary embodiment shown in FIG. 4, the first shelf 401 includes three mounting flanges 450. In some embodiments, the first shelf 401 may have more or fewer mounting flanges 450. The number of mounting flanges 450 may depend on one or more of the size, load bearing capacity, or other properties of the first shelf 401. In such implementations, the mounting flanges are positioned on the first shelf 401 such that the top surface 410 aligns with one or more of the plurality of markings 230 when the first shelf 401 is coupled to the mounting rails 300.

According to additional exemplary embodiments, the design and features of each of the shelves 400 is substantially similar to the first shelf 401. In these implementations, each of the shelves 400 is configured to selectively interface with the slots 350 such that a top surface of each of the shelves 400 aligns with one or more of the plurality of markings 230.

Figure 5:
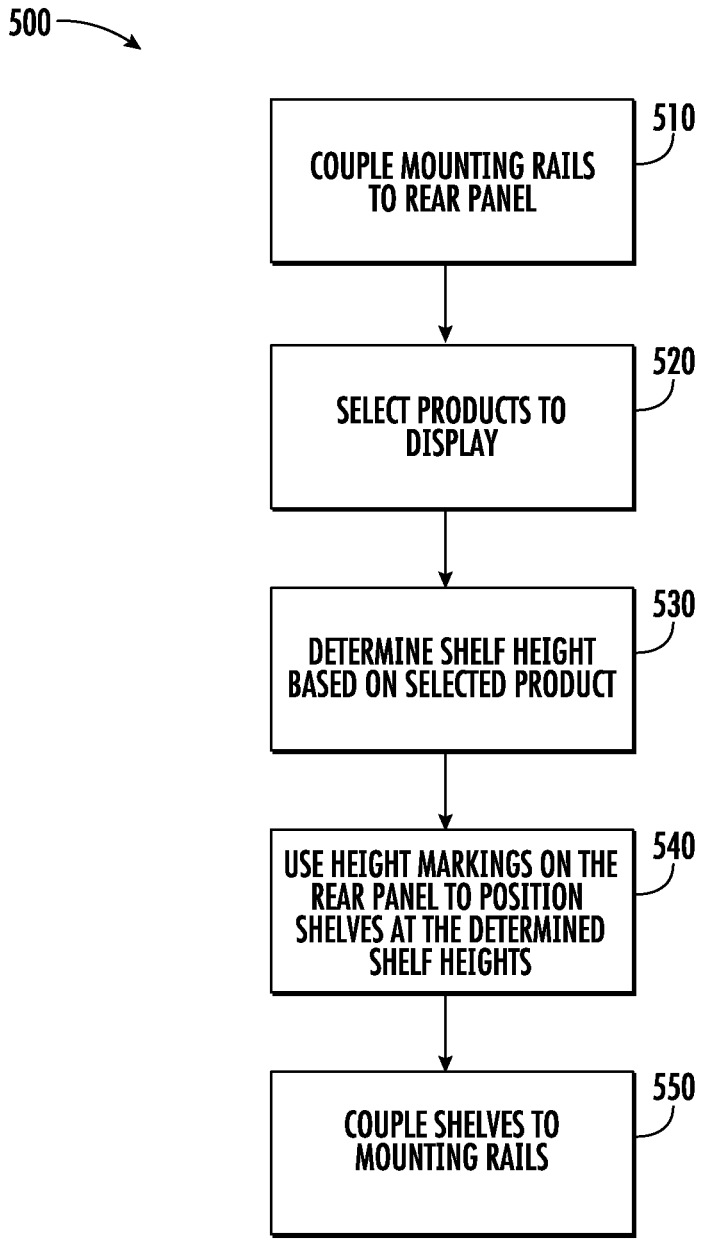
FIG. 5 is a block diagram of a method of assembling a display area for the refrigerated display case of FIG. 1, according to an exemplary embodiment.

Now referring to FIG. 5, a flowchart of a method for assembling the display area 105 of the refrigerated display case 100 is shown, according to exemplary embodiments. In an exemplary embodiment, the methods shown are performed by a user with the components shown in FIGS. 1-4.

At step 510, the mounting rails 300 are coupled to the panels 200. As described above, the panels 200 and mounting rails 300 may be configured to be modular such that multiple mounting rails 300 and panels 200 may be coupled together in series as shown in FIG. 2.

At step 520, products are selected to be displayed. Each of the products may be the same type, or the products may be of different types. The products may be selected based on visual merchandising techniques or plan-o-grams (POGs). A POG is a model that maximizes retail sales by planning the placement of retail products on shelves.

The POG for the refrigerated display case 100 may recommend the orientation of the product on each of the shelves 400, an amount of products on each of the shelves 400, number or spacing of shelves 400 included in the refrigerated display case 100, capability to facilitate product or brand identity, or positioning of additional refrigerated display cases. The POG may also recommend other configurations, orientations, or other parameters of the display area 105. The POG allows the user to design the display space 105 before starting method 500.

The products may have particular dimensions taken relative to the position in which user desires to display the product. For example, POG may recommend that a label indicating various specifications of the product is on a first, front facing side of the product. The front facing side may have a particular height and width. A second side of the product may define a bottom surface of the product configured to be supported by the top surface 410 of one of the shelves 400. The POG may recommend the amount of products based on the bottom surface of the product.

At step 530, a height is selected to position the shelf 400. The height may be selected based on the height of the product to be displayed. For example, the shelf 400 is positioned such that the products being displayed on a shelf below can be easily seen and accessed by a user. The height also may be predetermined by the POG. For example, the POG may recommend that the shelf 400 is positioned such that the products being displayed on a shelf below can be easily seen and accessed by a user. Additionally, the POG may recommend maintaining optimal spacing between shelves such that the amount of products (e.g., a maximum amount, an optimal amount, etc.) recommend by the POG may be displayed within the display space 105. For example, a first product on a first shelf may have a height of about 5 inches. A user may decide to use, or a POG may recommend a height of more than 5 inches (e.g., 6.25 inches) to position a second shelf, above the first shelf such that a user may easily see and access the first product. Additionally, the first shelf may be selected to be positioned relative to a bottom surface of the display area 105 (e.g., relative to the first end 220). A last shelf (e.g., a highest shelf) may be selected to be positioned relative to a top of the display area 105 (e.g., relative to the second end 225).

At step 540, the top surface of the shelf 410 is aligned with at least one of the plurality of markings 230. The alignment may be based on the height decided at step 530. For example, the height may found on the panels 200 using the plurality of markings 230 on the panels 200. More specifically, the POG may have recommended at step 530 that a first shelf should be placed 5 inches from a bottom of the panels 200 (e.g., first end 220). The user may quickly determine the 5 inch distance from the first end 220 of the panels 200 by the plurality of markings 230. Additionally, the user may have decided at step 530 that a second shelf should be placed 10 inches away from the first shelf. The user may quickly identify a 10 inch spacing by using the plurality of markings 230. For example, the first shelf may be aligned with a first marking of the plurality of markings 230 labeled as "5" as shown in FIG. 2. The first marking indicating a 5 inch spacing from the first end 220. The user may then quickly identify that a second marking of the plurality of markings 230, the second marking labeled as "15" indicating a 15 inch spacing from the first end 220. The user may align the top surface 410 of the shelf 400 with the markings parallel to the second marking such that the top of the second shelf is spaced approximately 10 inches away from the top surface of the first shelf.

In a further embodiment of step 540, an alternative spacing may have been selected for the shelves 400 at step 530. For example, a third shelf may have been selected to be spaced 4 inches above the second shelf as described above. The user may quickly identify the 4 inch spacing by counting the number of rows of the first set of markings 240 above the second shelf. More specifically, the user may count four rows of the first set of markings 240 that are spaced at 1 inch intervals. The total distance is approximately 4 inches. The user may then position the third shelf to align with the fourth row of the first set of markings 240 above the second shelf.

At step 550, the shelf 400 is coupled to the mounting rails 300 such that the alignment made at step 540 is maintained. For example, the user may have aligned the shelf at step 540. While suitably maintaining this alignment the user may insert the mounting flanges 450 into the slots 350 of the mounting rails 300. Each of the plurality of mounting slots 350 is positioned such that the top surface 410 of each of the shelves 400 aligns with at least one of the plurality of markings 230.

The user may repeat the method 500 until the display area has the desired number of shelves mounted to the mounting rails 300. For example, a user may decide to use or a POG may recommend using more than one shelf. In one example, a POG may recommend using exactly five shelves. The user may repeat method 500 until all five shelves have been positioned and coupled to the mounting rails 300.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims. It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

The construction and arrangement of the elements of the refrigeration system and valve diagnostic system as shown in the exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure.

The background section is intended to provide a background or context to the invention recited in the claims. The description in the background section may include concepts that could be pursued, but are not necessarily ones that have been previously conceived or pursued. Therefore, unless otherwise indicated herein, what is described in the background section is not prior art to the description and claims and is not admitted to be prior art by inclusion in the background section.

It is important to note that the construction and arrangement of the systems and methods as shown in the various exemplary embodiments is illustrative only. Additionally, any element disclosed in one embodiment may be incorporated or utilized with any other embodiment disclosed herein. For example, the methods of the exemplary embodiment described with reference to FIG. 5 may be incorporated with any of the components of the refrigeration system of the exemplary embodiment described with reference to FIG. 1. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A method of assembling a display area for a refrigerated display case comprising:

coupling a panel to a mounting rail, the panel having a plurality of markings indicating distances from a first panel end to a plurality of positions between the first panel end and a second panel end, the second panel end opposite the first panel end, wherein the plurality of markings are holes formed through the panel;

determining a first desired height for installation of a first shelf; and selectively coupling the first shelf to the mounting rail such that a top surface of the first shelf aligns with a first marking of the plurality of markings, the first marking indicating that a distance from the first panel end to the first marking corresponds to the first desired height.

2. The method of claim 1, further comprising selecting a first product of a plurality of products to be displayed within the refrigerated display case.

3. The method of claim 2, wherein determining the first desired height for installation of the first shelf is further based on the first product.

4. The method of claim 1, further comprising:

determining a second desired height for installation of a second shelf; and coupling the second shelf to the mounting rail such that a top surface of the second shelf aligns with a second marking of the plurality of markings, the second marking indicating that a distance from the first panel end to the second marking corresponds to the second desired height.

5. The method of claim 3, wherein determining the first desired height for installation of the first shelf based on the first product comprises determining the first desired height for installation of the first shelf based on a height of the first product.

6. The method of claim 3, wherein determining the first desired height for installation of the first shelf based on the first product comprises determining the first desired height for installation of the first shelf based on a plan-o-gram.

7. The method of claim 1, wherein determining a first desired height for installation of the first shelf comprises positioning the first shelf relative to a bottom surface of the display area.

8. The method of claim 4, wherein determining a second desired height for installation of the second shelf comprises positioning the second shelf relative to a top surface of the display area.

9. The method of claim 4, wherein selectively coupling the first shelf to the mounting rail comprises selectively receiving a portion of the first shelf into a portion of the mounting rail.

10. The method of claim 9, wherein the portion of the first shelf is a mounting flange and the portion of the mounting rail is a plurality of mounting slots.

11. The method of claim 10, wherein the plurality of mounting slots are disposed along at least one of a first column or a second column of the mounting rail.

12. The method of claim 10, wherein the plurality of mounting slots are disposed along the mounting rail between the first panel end and the second panel end of a rear wall of the refrigerated display case.

13. The method of claim 11, wherein the plurality of markings comprise:

a first set of markings disposed in a plurality of rows, each of the plurality of rows parallel to the first panel end; and a second set of markings aligned with a subset of the first set of markings and configured as depictions of numeric values indicating the distance from the first panel end to the depictions.

14. The method of claim 4, wherein selectively coupling the first shelf to the mounting rail comprises selectively coupling the first shelf and the second shelf equidistantly spaced in a predetermined increment to indicate the distance from the first panel end in the predetermined increment.

15. The method of claim 14, wherein the predetermined increment is between 1 inch and 5 inches.

16. The method of claim 13, wherein the second column is opposite the first column and extends between the first panel end and the second panel end.

17. The method of claim 16, wherein a first mounting rail is disposed at a left side and extending between the first panel end and the second panel end and a second mounting rail is disposed at a right side and extending between the first panel end and the second panel end.

18. The method of claim 17, wherein selectively coupling the first shelf and the second shelf to the mounting rail comprises selectively coupling the first shelf to each of the first mounting rail and the second mounting rail such that a top surface of the first shelf and the second shelf aligns with at least one of the first set of markings.

19. The method of claim 17, wherein selectively coupling the first shelf and the second shelf to the mounting rail comprises selectively coupling the first shelf to each of the first mounting rail and the second mounting rail such that a top surface of the first shelf and the second shelf aligns with at least one of the second set of markings.

20. The method of claim 1, wherein the holes are at least one of a circular shape, a square shape, or a triangle shape.

* * * * *